US007629521B1

(12) United States Patent
Chapman

(10) Patent No.: US 7,629,521 B1
(45) Date of Patent: Dec. 8, 2009

(54) VERSATILE NECK TRUSS SYSTEM FOR STRINGED MUSICAL INSTRUMENTS

(76) Inventor: Emmett H. Chapman, 6011 Woodlake Ave., Woodland Hills, CA (US) 91367

( * ) Notice: Subject to any disclaimer, the term of this patent is extended or adjusted under 35 U.S.C. 154(b) by 0 days.

(21) Appl. No.: 12/287,678

(22) Filed: Oct. 14, 2008

(51) Int. Cl.
*G10D 3/00* (2006.01)

(52) U.S. Cl. ..... 84/293

(58) Field of Classification Search ..... 84/293
See application file for complete search history.

(56) References Cited

U.S. PATENT DOCUMENTS

| | | | | | |
|---|---|---|---|---|---|
| 516,717 | A | * | 3/1894 | Anderberg | 84/293 |
| 1,446,758 | A | * | 2/1923 | McHugh | 84/293 |
| 2,460,943 | A | * | 2/1949 | Nelson | 84/293 |
| 2,510,775 | A | * | 6/1950 | Forcillo | 84/293 |
| 3,416,399 | A | * | 12/1968 | Baldoni | 84/293 |
| 4,074,606 | A | | 2/1978 | Fender | |
| 4,167,133 | A | * | 9/1979 | Adams, Jr. | 84/293 |
| 4,203,342 | A | * | 5/1980 | Montgomery et al. | 84/293 |
| 4,508,003 | A | * | 4/1985 | Smakula | 84/293 |
| 4,517,874 | A | | 5/1985 | Fender | |
| 4,557,174 | A | | 12/1985 | Gressett, Jr. | |
| 4,930,389 | A | * | 6/1990 | Kunstadt | 84/293 |
| 4,953,435 | A | * | 9/1990 | Chapman | 84/293 |
| 5,018,423 | A | * | 5/1991 | Bunker et al. | 84/293 |
| 5,233,122 | A | | 8/1993 | Kim | |
| 5,249,498 | A | * | 10/1993 | Wilfer et al. | 84/293 |
| 5,465,642 | A | * | 11/1995 | Goto | 84/293 |
| 5,696,334 | A | * | 12/1997 | Terry | 84/293 |
| 5,864,073 | A | | 1/1999 | Carlson | |
| 5,965,830 | A | * | 10/1999 | Carlson | 84/293 |
| 6,051,765 | A | * | 4/2000 | Regenberg et al. | 84/293 |
| 6,259,008 | B1 | * | 7/2001 | Eddinger et al. | 84/293 |
| 6,765,135 | B2 | * | 7/2004 | Takeuchi | 84/293 |
| 2004/0129126 | A1 | * | 7/2004 | Goto | 84/293 |

* cited by examiner

*Primary Examiner*—Jeffrey Donels
*Assistant Examiner*—Robert W Horn
(74) *Attorney, Agent, or Firm*—J. E. McTaggart

(57) ABSTRACT

A versatile four-way adjustable truss system in a stringed musical instrument is disposed uniformly within the instrument neck that provides or supports a fingerboard or fretboard on its top side. The bottom surface of the truss may be exposed along its full length and made flush with the bottom neck surface and smooth to the touch. The truss is made adjustable at both ends in either tension or compression and is securely fastened to the neck at an intermediate fastening point so as to form two substantially co-linear neck sections either of which can be adjusted independent of the other, via an associated adjustment nut constrained in a corresponding thrust cavity configured in the neck, to satisfy a desired section profile requirement in a range that includes both concave and convex curvature.

14 Claims, 3 Drawing Sheets

VERSATILE NECK TRUSS SYSTEM FOR STRINGED MUSICAL INSTRUMENTS

FIELD OF THE INVENTION

The present invention relates to stringed musical instruments generally of the guitar family, and more particularly to an improved adjustable truss implementation, in a stringed instrument neck supporting a fretboard or forming a fretless fingerboard, that enables adjustment of curvature independently in two sections of the neck in a range that includes both concave and convex to satisfy profile requirements unique to each section.

BACKGROUND OF THE INVENTION

In stringed musical instruments such as guitars and bass guitars, a main component is the neck that provides or supports a fretboard or fretless fingerboard. The neck is typically made from wood and is ordinarily supplied initially as being nominally flat along its length, free of neck curvature. For purposes of the present disclosure, "neck length" refers to only that portion of the neck that is associated with the fretboard/fingerboard, and is not intended to include any substantial portion of the neck located within the body of the instrument, e.g. as in thru-neck type instrument construction. Even a newly fabricated neck may already have some amount of inherent curvature, concave or convex, and such bowing or arching is not always symmetrical over the neck length.

When the instrument is strung and tuned, the high tension in the strings, in the order of one or two hundred pounds, sets up a strong continuous stress load that tends to bow the neck concavely. Depending on the strength of a particular neck, string tension often introduces some amount of concave curvature that results in a non-uniform increase in the string-to-fret separation, known as "high action", making the instrument difficult to play by placing excessive demands on fingering technique.

In initial setup or refurbishing of a stringed musical instrument, a luthier or technician typically uses all available adjustment capability to achieve the desired string-to-fret spacing. In the absence of truss tension adjustment, the two main adjustments available are the bridge and nut heights. Many instruments are provided with truss rods with tension adjustment that can reduce neck curvature only if the curvature is concave, and their effect is spread over the full length of the neck.

In the art of the luthier, even a substantially flat neck with uniform low string spacing throughout the neck length would be considered no more than a marginally acceptable compromise. Ideally the luthier would prefer some slight concave curvature, known as "relief", over a lower pitched section of the neck and a straighter profile over a higher pitched section. This represents a fortuitous circumstance that rarely occurs in manufacture and setup, and cannot normally be accomplished by adjustment in trussed necks of known art, thus requiring laborious "relief" dressing of particular regions of the fretboard by a skilled luthier. Conventional tensioned truss rods or even the relatively rare truss types that can be alternatively placed in compression for adjustment regarding curvature, are all subject to the inherent limitation of known art: their effect is spread over the full length of the neck.

Stringed musical instrument owners, manufacturers, luthiers and repair technicians all face a random variety of variables in instrument neck curvature. Some new necks may already exhibit some amount of curvature: concave or convex. Especially in absence of truss reinforcement, and even with a tension truss, a selection process may be required in quality control wherein necks found to have excessive concave or convex curvature may have to be discarded and replaced. Hopefully an initially straight neck might be strong enough to resist bending and thus remain playable, while a neck with slight convex curvature could even tend to straighten and thus could improve in uniformity and playability after one or more service refurbishments including bridge height adjustments, over a period of time. More typically, undesired neck curvature is likely to worsen with time, and could end up becoming even less correctable with existing truss construction of known art. Asymmetrical curvature affecting only a section of the neck length cannot be adjustably corrected by any truss system in the field, and instead may require extensive dressing of the crowns of the frets by a skilled luthier.

DISCUSSION OF KNOWN ART

U.S. Pat. No. 5,233,122 issued in 1993 to Kim for GUITAR WITH NECK TRUSS ROD SUPPORTING CONSTRUCTION discloses an extension member at one end of a rectangular metal truss rod anchored to a front board of the guitar body in a dovetail manner, exemplifying a type of truss that attempts to prevent neck "cracking and bowing" by functioning strictly as a "brute-force" non-adjustable neck-stiffening beam element with no longitudinal stress applied. The truss is entirely enclosed in the neck and located immediately beneath the fretboard.

U.S. Pat. No. 5,864,073 for LAMINATED NECK FOR GUITARS AND COMBINATION THEREOF WITH ADJUSTMENT SYSTEM issued in 1999 to Carlson, assigned to Fender Musical Instrument Corporation, typifies traditional trussed stringed instrument neck construction of a type that has found wide usage in known art. A metal truss rod is fully enclosed in the neck beneath the fretboard in an arched shape along a non-uniform groove of varying depth routed in the main neck section and enclosed by a separate filler part beneath the truss rod. This approach imposes a burden of structural complexity and addresses only concave neck curvature through longitudinal tension applied to the truss, failing to provide reverse compensation capability for correcting convex neck curvature.

In addition to the aesthetic compromises and adjustment difficulties arising from front-access adjustment, the practice of fully enclosing the truss imposes a serious serviceability shortcoming: if the threaded adjustment means on the truss becomes stripped or the adjustment tool interface such as a screwdriver slot in the end of the truss rod becomes deformed to a point of malfunction, removal of the truss for repair or replacement is extremely difficult, e.g. requiring removal of the fretboard from the neck, and in some instances truss repair/adjustment may be practically impossible, rendering the instrument unrepairable.

U.S. Pat. No. 4,557,174 issued in 1985 to Gressett, Jr., assigned to Fender, discloses a GUITAR NECK INCORPORATING DOUBLE-ACTION TRUSS ROD APPARATUS, described as providing "compressive or tensile loading of the truss rod for flexing of the neck in either direction". A sleeve 33, located in a central region of the truss for purposes of transmitting lateral thrust from the truss to the neck, is in "sliding metal-to-metal relationship between the truss rod and the sleeve 33" and thus fails to provide a longitudinally anchored point in the mid-region of the truss and thus fails to enable separate independent curvature correction adjustment of each half. Clearly this '174 patent addresses only simple full length neck bowing.

U.S. Pat. No. 4,953,435 issued in 1990 to the present inventor, Emmett H. Chapman, for REAR-ACCESS TRUSSED NECK CONSTRUCTION FOR STRINGED MUSICAL INSTRUMENTS, discloses improved trussed neck structure that was incorporated as a refinement in the Chapman Stick (registered trademark) where uniform low action is desired to facilitate a special string-tapping playing technique (see U.S. Pat. Nos. 3,833,751, 3,868,880 and 4,953,435 by the present inventor). A substantially straight truss member is disposed uniformly in a groove along the rear side of the neck such that a surface of the truss is exposed along its full length, flush with the rear neck surface. A readily accessible rear-access threaded fabrication/service adjustment member provides convenient capability of applying an adjustable amount of either tension or compression as required to offset an unwanted neck-bending tendency in either direction, concave or convex, thus correcting and securing the neck in a straightened, stabilized condition.

Years of experience have revealed many instances where further degree of neck adjustment capability is required. In some necks, particularly long necks, there may be unwanted curvature that, in the absence of compensation, is not uniformly distributed along the total length; instead it may be asymmetric, e.g. predominant in one or other half of the total neck length, so that it cannot be fully compensated by adjustment of a full length truss rod whether in compression or in tension. Thus a need has been identified for further refinement in which each half section of the total neck length is made independently adjustable for correcting either convex or concave curvature.

U.S. Pat. No. 6,051,765, issued in 2000 to Regenberg et al for a GUITAR WITH CONTROLLED NECK FLEX, encloses the truss in an inverted U-shaped channel member that fits into a U-shaped channel machined into the back of the fingerboard. First and second spacers are welded or otherwise fastened onto the truss rod, separated from each other at predetermined locations along the truss so as to divide the total truss rod length into three regions with the two spacers, each acting in compression against the fingerboard to act on curvature. Since the truss rod can be deployed only in tension, i.e. for reducing concave neck curvature only, it fails to provide correction for convex neck curvature. These "spacers" exert vertical pressure on the neck and fingerboard to create upward force at selected points along the board when the truss is tightened in tension. Since the apparatus is buried within the neck under the laminated fingerboard, each spacer's location must be preset and the spacer welded or fastened to the truss in an arbitrary location in fabrication, after which the spacers cannot be adjusted or relocated to customize the truss action along the neck length. The three "regions" thus operate in a manner that differs from the two separately adjustable sections of the single truss or two in-line half-length trusses of the present invention.

In the above-described and all other known prior art in neck trusses for stringed musical instruments, even when both regular and reverse compensation capability are provided, they act over the full length of the neck, and as such, in a neck with compound or asymmetric curvature where the two sections of the neck require corrective compensation in different amounts and/or opposite directions, trusses of known prior art are inherently difficult or impossible to adjust in a manner to attain an the ideal neck profile commonly sought by luthiers, i.e. that of a concave curve along the lower pitched section, known as "relief", and straight profile along the higher pitched section.

OBJECTS OF THE INVENTION

A primary object of the present invention is to provide an improved trussed neck for stringed instruments, including adjustment means for controlling neck profile relative to the strings including desired curvature in either convex or concave direction in either or both sections of the full length of the neck in order to accomplish a desired combination of straightness and concave curvature known as "relief" by independent adjustment of each half section of the truss to place it in compression or tension as required in order to control the contour of each of the two sections of the neck independently so as to enable flexibility of adjustment regarding fingerboard curvature and accomplish a desired final contour that requires minimal dressing of frets.

It is a further object to provide an embodiment wherein the truss system allows the neck to be fabricated as a single piece of material, the front side serving directly as a playing surface thus eliminating any need for a separate fingerboard part, and the rear side containing the truss exposed in a channel, thus facilitating truss/neck assembly and eliminating any need for additional neck parts such as enclosed strips.

It is a still further object that the truss be readily removable for service and/or replacement without removing the fingerboard from the neck.

SUMMARY OF THE INVENTION

These and other objects and advantages have been accomplished in the improved four-way adjustable trussed neck structure of the present invention in which a substantially straight truss member, which may be implemented as one piece or as two substantially co-linear sections, is disposed uniformly within the neck, optionally in a channel configured along the rear side of the neck such that a flat surface of the truss is exposed along its full length, optionally flush with the rear neck surface and extending fully to the channel edges so as to feel smooth to the touch. The truss is made adjustable at both ends in either tension or compression and is securely fastened to the neck at an intermediate fastening point so as to form two substantially co-linear neck sections either of which can be adjusted independent of the other, via an associated adjustment nut constrained in a thrust cavity configured in the neck, to satisfy a desired section profile requirement in a range that includes both concave and convex curvature.

A full understanding of this invention will be gained through a study of the accompanying drawings along with the following descriptive text.

DETAILED DESCRIPTION

Figure 1:
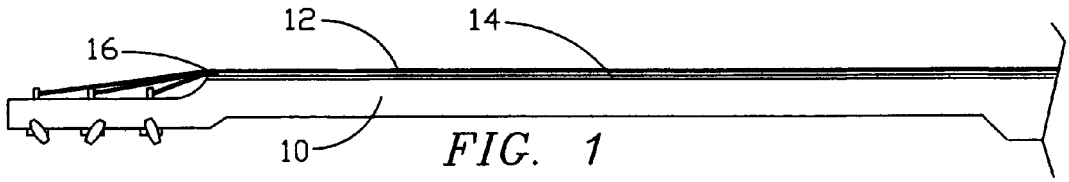
FIG. 1 PRIOR ART
FIG. 1 is a side view of a stringed musical instrument neck of a known non-truss type illustrating a flat fingerboard and a closely spaced parallel location of the strings.

FIG. 1 is a side view of a stringed musical instrument neck 10 and tuning headstock of known art without a neck truss showing string location 12 spaced uniformly above the fingerboard 14 by a string-support nut 16 at the left hand end and a bridge (not shown) on the instrument body at the right hand end. For simplicity fingerboard 14 is shown as fretless, however the present description applies equally to a fretted fingerboard, i.e. a fret-board. In either case it is generally desired for ease of playing that the fingerboard 14 be kept substantially straight, i.e. longitudinally flat so that the nut and bridge can hold the taut strings at a close spacing above the fingerboard or frets, known as "low action", that is substantially uniform throughout the neck length to generally facilitate finger-stopping and string-tapping while preventing vibrating strings from buzzing against frets or fingerboard 14.

The fingerboard 14 can be made as an integral part of the neck, but more typically it is made as a separate thin layer of different material that is attached to and thus shaped by the neck 10. To the extent that an instrument falls short of providing ideal low action everywhere along the fingerboard/fretboard, it is more difficult to play: the player is forced to compensate and develop corrective playing techniques.

Figure 2:
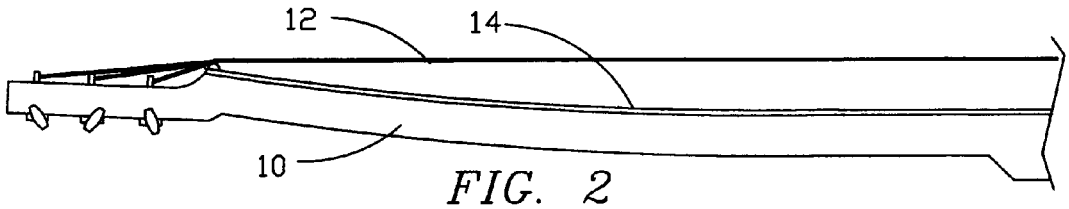
FIG. 2 PRIOR ART
FIG. 2 depicts an instrument neck as in FIG. 1 showing (in exaggeration) concave curvature induced by string tension.

FIG. 2 depicts an instrument neck 10 as in FIG. 1 but with concave curvature of the neck 10 and fingerboard 14. The amount of curvature shown in FIGS. 2 and 6-10 is exaggerated for clarity of illustration; in actuality players generally desire the "action" (string-to-fret spacing) to be low while avoiding string buzz on the frets.

When the strings 12 are tensioned as required for tuning and playing purposes, stress in the order of hundreds of pounds acts on the neck in a manner that inherently tends to bend the neck and introduce concave curvature. Even if this curvature is compensated by adjustment of the bridge support (located beyond the right hand end in FIG. 1), the result is a compromise in which excessive concave curvature remains as a undesired problem with increased sting spacing, i.e. high "action", in the mid-region of the fingerboard that cannot be corrected by setting of the bridge.

Since the neck 10 is typically made from wood, it is subject to both initial warping and variations in strength against warping under the continuous stress in the instrument. Unfortunately neck curvature may develop and increase further with the passage of time to an extent that makes the instrument virtually unplayable. This disadvantage of non-trussed instrument necks led to the improvement of incorporating some form of truss for neck reinforcement, preferably adjustable.

Figure 3:
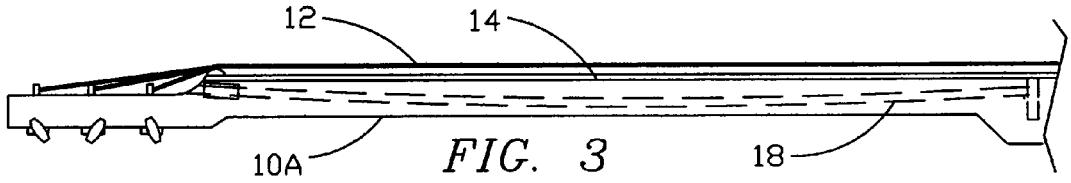
FIG. 3 PRIOR ART
FIG. 3 depicts an instrument neck similar to that of FIGS. 1 and 2 but equipped with a known tension type of truss rod that can be adjusted from one end to act in a manner and direction to offset and minimize concave neck curvature of the type shown in FIG. 2.

FIG. 3 depicts an instrument neck 10A equipped with a known truss rod 18 of a type described above in connection with U.S. Pat. No. 4,557,174, intended to provide adjustment with regard to neck curvature, e.g. of the type shown in FIG. 2. However, this structure, being deployable in tension only, fails to provide capability of correcting curvature in both directions, i.e. concave/convex, and, as described above, is subject to other disadvantages and limitations including inability to adjust two neck sections independently.

Figure 4:
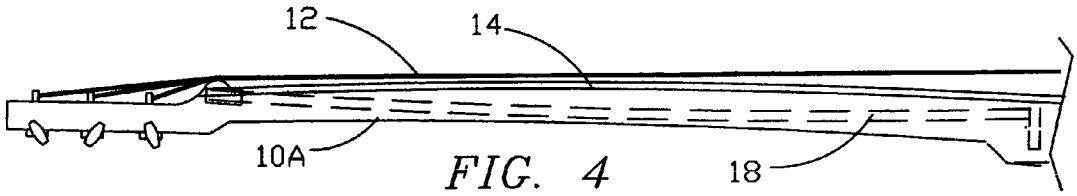
FIG. 4 PRIOR ART
FIG. 4 depicts an instrument neck with convex curvature that cannot be corrected by a neck truss of the tension type shown in FIG. 3.

FIG. 4 depicts an instrument neck 10A with a tensioned truss 18, as in FIG. 3 but shown here deformed by convex curvature that cannot be corrected by the truss 18 since it can be deployed in tension only; tensioning the truss 18 would only increase the amount of convex curvature.

Figure 5:
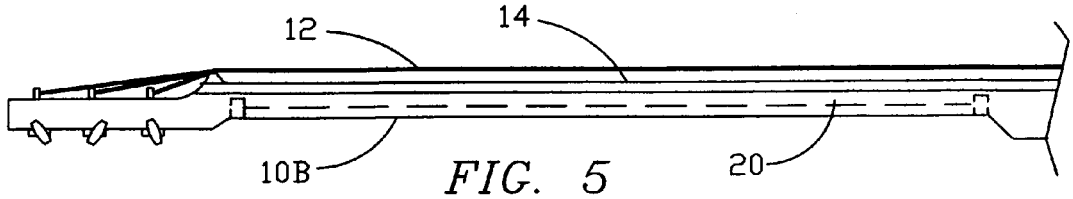
FIG. 5 PRIOR ART
FIG. 5 depicts an instrument neck fitted with the inventor's proprietary dual mode type of neck truss that can be deployed in tension to offset concave curvature, as shown in FIG. 2, or alternatively, in compression to offset convex curvature as shown in FIG. 4.

FIG. 5 depicts an instrument neck 10B fitted with a special known type of dual mode neck truss rod 20 that in addition to being deployable in tension to correct concave curvature as in FIG. 2, can alternatively be deployed in compression to correct convex curvature (as shown in FIG. 4). Adjustment is implemented by a machine nut engaging a threaded end of truss rod 20, the opposite end being anchored in the neck 10B. Truss rod 20 is square in cross-sectional shape and is located in a channel machined in neck 10B, optionally with one flat edge exposed flush with the bottom side of neck 10A. This type of truss system is disclosed in U.S. Pat. No. 4,953,435 by the present inventor, described above.

FIGS. 6-9 show string locations 12 over a fingerboard 14 illustrating four types of asymmetric neck deformation that affect predominantly only half of the neck length and thus cannot be satisfactorily straightened by any known instrument neck truss systems including those of FIGS. 3 and 5.

Figure 6:
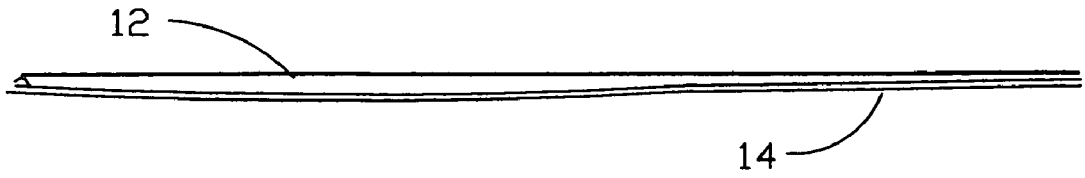
FIG. 6 illustrates concave curvature in the left hand half section of the neck.

FIG. 6 shows string location 12 over a fingerboard 14 with concave curvature in the left hand half neck section only, shown somewhat exaggerated for clarity. If the amount of concave curvature shown in the left hand section could be adjusted to an ideal amount, and the right hand section held straight, this pattern would satisfy the standards of a luthier seeking optimal "low action", i.e. close string-to-fret spacing.

Figure 7:
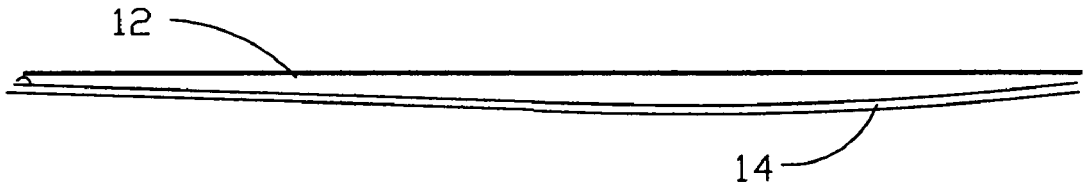
FIG. 7 illustrates concave curvature in the right hand half section of the neck.

FIG. 7 shows string location 12 over fingerboard 14 with concave curvature in the right hand half section of the neck.

Figure 8:
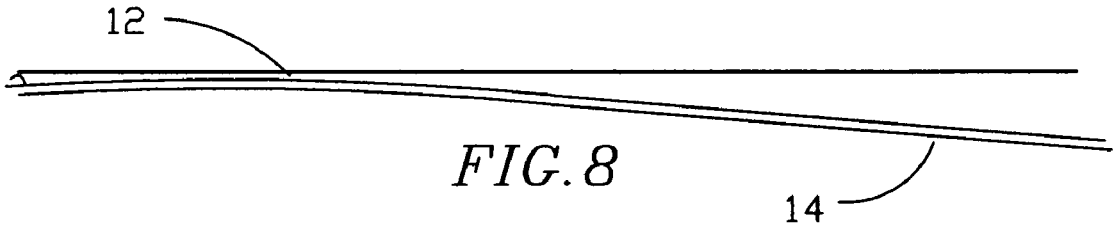
FIG. 8 illustrates convex curvature in the left hand half section of the neck.

FIG. 8 shows string location 12 over a fingerboard 14 with convex curvature in the left hand half section of the neck.

Figure 9:
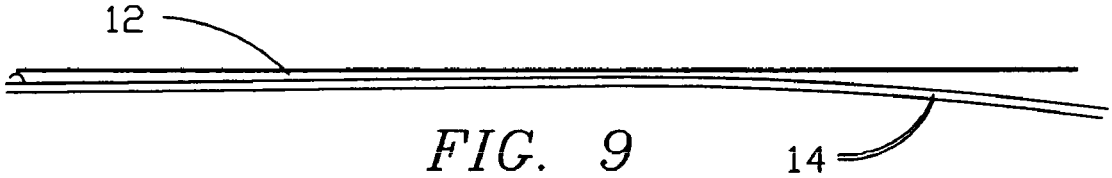
FIG. 9 illustrates convex curvature in the right hand half section of the neck.

FIG. 9 shows string location 12 over a fingerboard 14 with convex curvature in the right hand half section.

Figure 10:
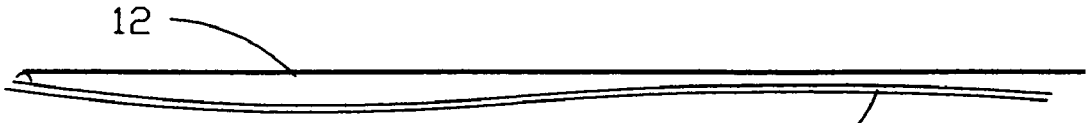
FIG. 10 illustrates concave curvature in the left hand half section and convex curvature in the right hand half section.

FIG. 10 shows string location 12 over a fingerboard 14 with an S shaped profile, i.e. concave curvature in the left hand section and convex curvature in the right hand half section, a condition that cannot be corrected by the single full length trusses of known art. If the concave curvature in the left section could be reduced and the convex curvature in the right section eliminated to a substantially straight condition, the overall profile would conform to the desired viable pattern as described in connection with FIG. 6.

Similarly, each of the conditions shown in FIGS. 7-9 could be transformed into a desired viable pattern if each half section could be adjusted for curvature independently in either direction.

Figure 11:
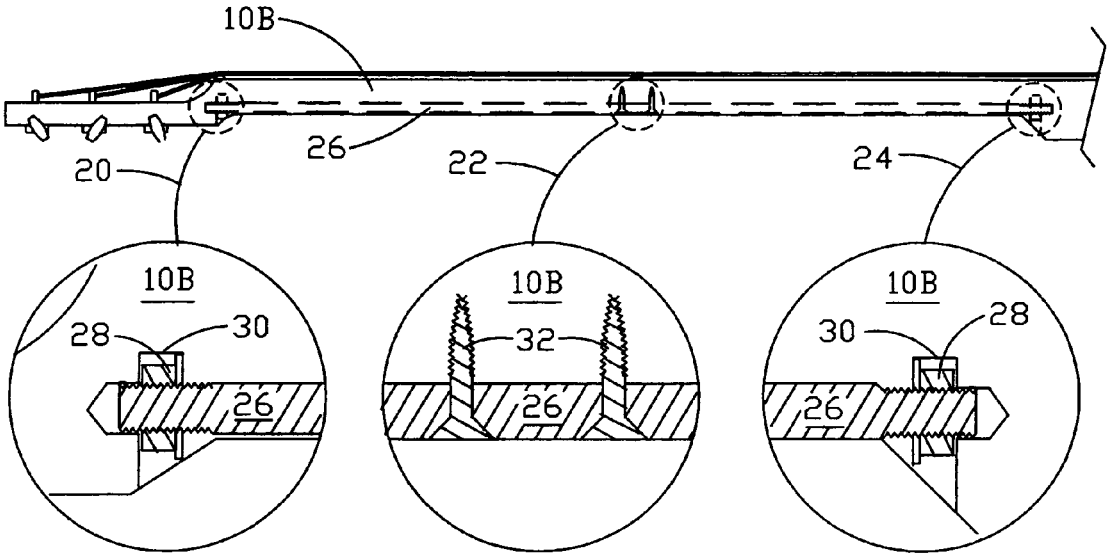
FIG. 11 is a side view of an instrument neck equipped with a truss system of the present invention showing enlarged cross sections at midpoint and end points.

FIG. 11 is a side view of a stringed musical instrument neck 10B equipped with the four-way adjustable truss 26 of the present invention which is capable of correcting asymmetric concave and/or convex curvature as in FIGS. 6-10 by independent adjustment in each of two sections of the neck.

The enlarged cross-section 22 at the mid-region of neck 10B shows truss 26 anchored to neck 10B by a pair of screw fasteners 32 with flat countersunk heads in a secure manner that prevents any relative displacement laterally or longitudinally. At each of the end regions 20 and 24, an adjustment nut 30 is threadedly engaged with a threaded end section of truss 26 which is fitted snugly in a channel configured along the bottom side of neck 10B.

Adjustment nuts 28 are located in thrust cavities 30 configured in the neck 10B. At each of the end regions 20 and 24, the nut 28 can be rotated in one direction to bear against the side of thrust cavity 30 to deploy truss 26 in tension or rotated in the opposite direction to bear against the opposite side of thrust cavity 30 to deploy truss 26 in compression. Optionally flat washers may be deployed as shown at the pressured side of each nut 30 for spreading the distribution of the force applied to the neck 10B.

Figure 12:
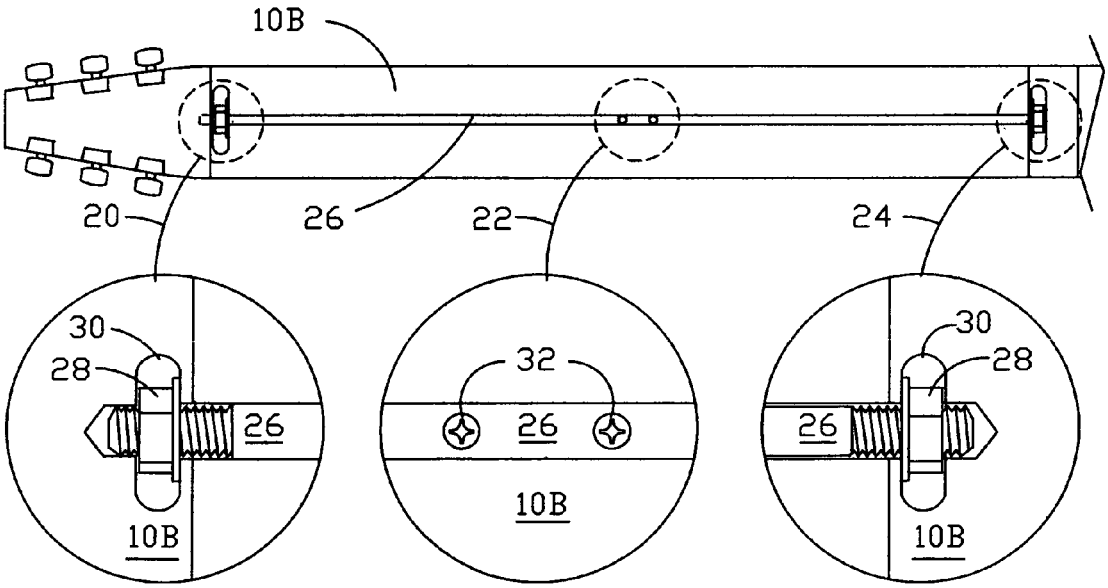
FIG. 12 is a bottom view of the instrument neck and truss shown in FIG. 11 including enlarged views at the midpoint and end points.

FIG. 12 is a bottom view of the instrument neck 10B and truss 26 shown in FIG. 11 including enlarged bottom views of above-described items in the midpoint fastened region 22 and the end point adjustment regions 20 and 24. Thrust cavities 30 are dimensioned in width to fit closely on each side of the nut 28 and in length to allow entry of an open-end wrench for adjustment.

Truss 26 is typically made square in cross-section, but could be made in another shape such as round, elliptical or rectangular. If the truss has an exposed surface, it should be made flush with adjacent neck surfaces and extend fully thereto with no substantial gaps, thus providing a smooth feel of the thumb on the neck. As an alternative to exposing one surface as shown, the truss could be entirely enclosed within the neck but preferably close to the bottom surface for effective adjustment action regarding curvature. Alternatively the truss could be located at or near the top surface of the neck: in that instance the effect of truss tension/compression on direction of neck curvature would be reversed.

Fastening of the central region of the truss 26 to neck 10B could be implemented with alternative fasteners such as pins instead of screws, an additional number of fasteners, or providing an additional metal member welded or otherwise fastened onto the central region of truss 26 and securely captivated in a thrust cavity similar to thrust cavities 30 configured in neck 26. Such pins or other alternative fastener members may be oriented in any direction, for example transverse instead of the perpendicular orientation of screws 32 shown in FIG. 11.

As an alternative to locating the ends of said truss in close proximity to the ends of the neck as shown, the invention could be practiced with the truss made shorter or longer relative to the neck at one or both ends.

As an alternative to the one-piece dual truss described above, the truss can be made from two separate truss sections interfacing at the designated truss-to-neck fastening region that includes the boundary between first and second adjacent sections of said neck. In this embodiment the truss ends in the mid region of the neck are attached by truss-to-neck attachment means located in the designated truss-to-neck fastening region, so as form a two-piece dual truss that is functionally equivalent to a one-piece dual truss.

This invention may be embodied and practiced in other specific forms without departing from the spirit and essential characteristics thereof. The present embodiments therefore are considered in all respects as illustrative and not restrictive. The scope of the invention is indicated by the appended claims rather than by the foregoing description. All variations, substitutions, and changes that come within the meaning and range of equivalency of the claims therefore are intended to be embraced therein.

What is claimed is:

1. A truss system, contained in a neck of a stringed musical instrument for independent adjustment and control with regard to curvature in two separate regions of the neck and the associated fingerboard/fretboard, adjustably deployable in one direction for reduction of concave curvature and in an opposite direction for reduction of convex curvature, particularly directed to localized adjustment with regard to asymmetric neck curvature in either direction in different sections of the neck, the truss system comprising:

a rigid truss located within a truss channel disposed lengthwise within the neck generally parallel to the fingerboard/fretboard, said rigid truss being fastened to the neck in a longitudinally secure manner by truss-to-neck fastening means at a designated truss-to-neck fastening location defining a boundary between first and second adjacent sections of said neck;

first bidirectional truss force adjustment means, located in a first end region of said truss, made and arranged to apply force to the first neck section via the first section of said truss in a manner to (1) place the first section of said truss in tension and thus apply adjustable force to the first neck section in a location and direction that modifies curvature in the first neck section in a first direction when said adjustment means is adjusted in a first direction, and (2) place the first section of said truss in compression and thus apply adjustable force to the first neck section in an opposite direction that modifies curvature in the first neck section in a second and opposite direction when said adjustment means is adjusted in a second and opposite direction; and second bidirectional truss force adjustment means, located in a second end region of said truss, made and arranged to apply force to the second neck section via the second section of said truss in a manner to (1) place the second section of said truss in tension and thus apply adjustable force to the second neck section in a location and direction that modifies curvature in the second neck section in a first direction when said adjustment means is adjusted in a first direction, and (2) place the second section of said truss in compression and thus apply adjustable force to the second neck section in an opposite direction that modifies curvature in the second neck section in a second and opposite direction when said adjustment means is adjusted in a second and opposite direction.

2. The truss system as defined in claim 1 wherein said truss-to-neck attachment means comprises at least one screw fastener traversing said truss via a close-fitting opening configured in the truss and engaging the neck at the designated truss-to-neck fastening location.

3. The truss system as defined in claim 2 wherein said truss is made generally rectangular in cross-sectional shape, thus having a flat bottom surface.

4. The truss system as defined in claim 3 wherein said truss is made generally square in cross-sectional shape.

5. The truss system as defined in claim 3 wherein the screw fastener is configured with a flat head and the opening is configured with a countersink shape to make the flat head flush with the flat bottom surface of the truss.

6. The truss system as defined in claim 1 wherein each said bidirectional truss force adjustment means comprises:

two threaded end sections configured in said truss, one at each opposite end region thereof; and a pair of threaded adjustment machine nuts, threadedly engaged one on each said threaded end section of the truss and disposed in a corresponding one of two cavities that are configured in the neck and dimensioned to each closely flank the corresponding nut such that when said nut is rotated in a first direction, the corresponding section of said truss is deployed in tension, enabling adjustment of curvature of a first direction in the corresponding neck section, and, when said nut is rotated oppositely in direction, the corresponding section of said truss is deployed in compression, enabling adjustment of curvature of the corresponding neck section in a direction opposite the first direction.

7. The truss system as defined in claim 1 wherein the first and second neck sections extend substantially to full length of the neck and accordingly first and second end regions of said truss are located in first and second end regions of the neck.

8. The truss system as defined in claim 1 wherein said truss is divided into two separate truss sections with proximal ends located in the designated truss-to-neck fastening region that includes the boundary between first and second adjacent sections of said neck, each truss section being securely attached to the neck by truss-to-neck attachment means located in the designated truss-to-neck fastening region containing proximal ends of the truss sections, so as to form a two-piece dual truss that is functionally equivalent to a one-piece doubly-adjustable truss.

9. The truss system as defined in claim 7 wherein said first and second neck sections are made substantially equal in length, extending from the designated truss-to-neck fastening location to corresponding opposite neck end regions, thus enabling each half of the neck to be independently adjusted with regard to curvature.

10. A truss system, contained in a neck of a stringed musical instrument for adjustment and correction of curvature of the neck and associated fingerboard/fretboard, adjustably deployable in one direction for correction of concave curvature and in an opposite direction for correction of convex curvature, particularly directed to focused correction of asymmetric neck curvature wherein either concave or convex curvature may predominate exclusively in different sections of the neck, said truss system comprising:

a rigid truss extending lengthwise substantially full length along the neck and located within a truss channel configured lengthwise in the neck, said truss being configured with a threaded section at each end;

a pair of threaded adjustment machine nuts, each threadedly engaged on a corresponding threaded end section of said truss;

truss attachment means, located at a predetermined intermediate location between two opposite end regions of the neck, made and arranged to securely fasten the truss to the neck at a predetermined fixed fastening location between the two opposite end regions of the neck, thus creating two neck sections, one supporting a lower-pitched section of the fingerboard and the other supporting a higher-pitched section thereof, and two corresponding truss sections sharing the common fixed fastening location;

said neck being configured on the bottom side thereof, in each of two opposite end regions, with a thrust cavity that traverses and extends substantially perpendicular to the truss channel, each thrust cavity being configured and dimensioned to contain and constrain a corresponding one of said nuts on both sides thereof by compressive force transmitted to material of the neck such that, when either of said nuts is rotated in a first direction, the corresponding truss section is deployed in tension, and, when either of said nuts is rotated in a second and opposite direction, the corresponding truss section is deployed in compression, whereby each truss section is made to be independently and bi-directionally adjustable with regard to curvature of the corresponding neck section.

11. The truss system as defined in claim 10 wherein said truss fastening means comprises at least one screw fastener traversing a corresponding close-fitting opening configured in said truss and engaging the neck at the predetermined fastening location.

12. The truss system as defined in claim 10 wherein said rigid truss is rectangular in cross-sectional shape.

13. The truss system as defined in claim 10 wherein said rigid truss is square in cross-sectional shape and made from stainless steel.

14. The truss system as defined in claim 10 wherein said rigid truss is made to have a cross-sectional shape selected from a group that includes square, rectangular oriented vertically, rectangular oriented horizontally, D-shaped, triangular and other polygon shapes, wherein a flat bottom side of said rigid truss is made to be flush with adjacent neck material on the bottom side of the neck and to extend fully to opposite sides of the truss channel so as to feel smooth to human touch along the bottom surface of the neck.

* * * * *